US006237367B1

(12) United States Patent
Cheng

(10) Patent No.: US 6,237,367 B1
(45) Date of Patent: May 29, 2001

(54) EARRING CONNECTOR

(76) Inventor: Howard Cheng, 2821 S. Quinn St., Chicago, IL (US) 60608

( * ) Notice: Subject to any disclaimer, the term of this patent is extended or adjusted under 35 U.S.C. 154(b) by 0 days.

(21) Appl. No.: 09/590,397

(22) Filed: Jun. 8, 2000

(51) Int. Cl.[7] ..... A44C 7/00
(52) U.S. Cl. ..... 63/12; 63/13
(58) Field of Search ..... 63/12, 13

(56) References Cited

U.S. PATENT DOCUMENTS

| | | | | |
|---|---|---|---|---|
| 245,297 | * | 8/1881 | Heckmann | 63/12 |
| 260,692 | | 7/1882 | Krementz . | |
| 271,121 | * | 1/1883 | Riley et al. | 63/12 |
| 785,857 | * | 3/1905 | Cassity | 24/114.8 |
| 872,691 | | 12/1907 | Seidl . | |
| 3,116,616 | | 1/1964 | Bangs . | |
| 3,208,239 | | 9/1965 | Pintarelli . | |
| 3,673,815 | | 7/1972 | Pintarelli . | |
| 4,003,217 | * | 1/1977 | Evans et al. | 63/12 |
| 5,433,088 | * | 7/1995 | Mahar | 63/12 |

FOREIGN PATENT DOCUMENTS 31731 11/1884 (DE) .

* cited by examiner

*Primary Examiner*—Anthony Knight
*Assistant Examiner*—Andrea Chop
(74) *Attorney, Agent, or Firm*—Andrus, Sceales, Starke & Sawall

(57) ABSTRACT

A loop-typed pierced earring has a pivotally mounted ear post that spans the gap in the ring and moves in an arc transverse to the plane of the ring from an open position, to permit insertion through the ear lobe, to a locked position with the ear post free end held in a locking detent in the other end of the ring body. Movement of the ear post end into the locking detent forces a slight inward deflection of the resilient end post, after which the end springs into engagement with a locking recess. Attachment of the earring is simple and direct and requires no visual alignment by the wearer.

6 Claims, 1 Drawing Sheet

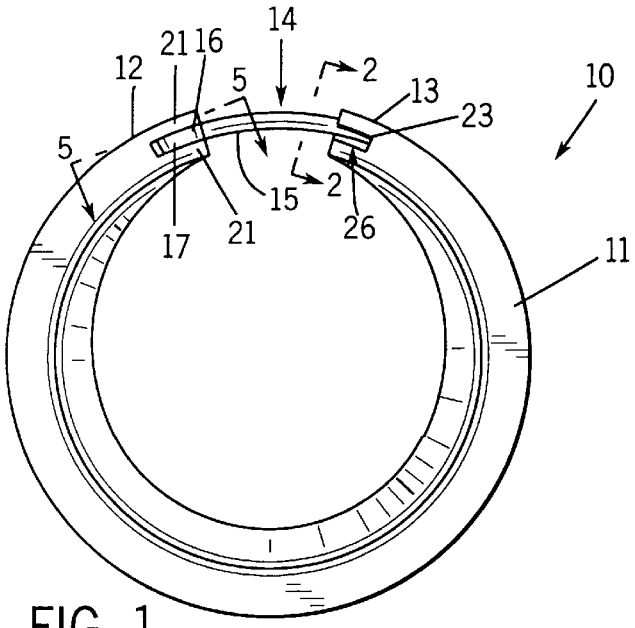
FIG. 1
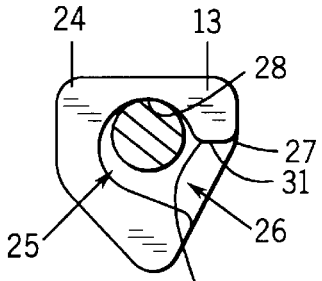
FIG. 2
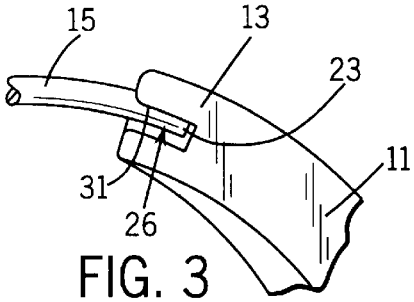
FIG. 3
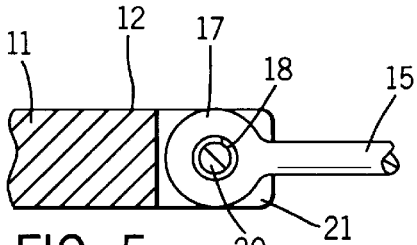
FIG. 5
FIG. 4
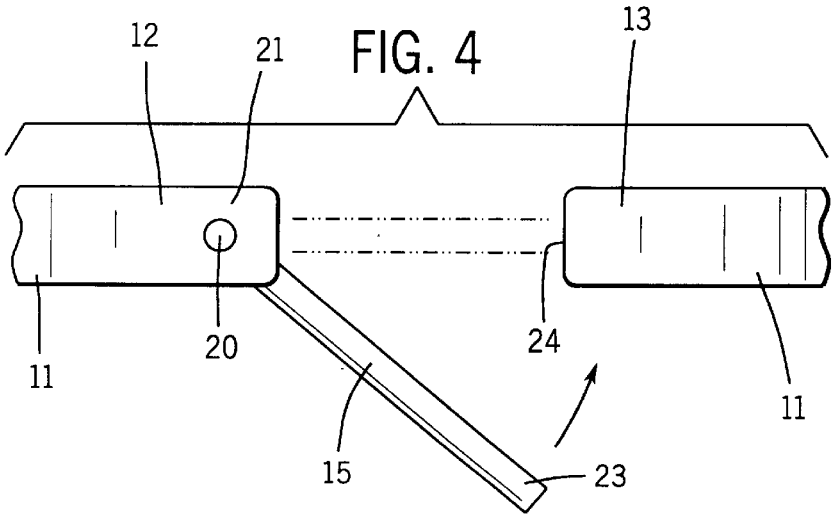

EARRING CONNECTOR

The present invention pertains to an earring connector and, more particularly, to a connector for an earring for a pierced ear that provides a secure and simple mounting.

Pierced earrings in the prior art utilize a variety of connectors to secure the ear post or ear wire within the ear lobe of the wearer to prevent accidental dislodgment and loss. In a conventional circular or loop ear ring, the ring is provided with a gap to receive the ear lobe and the ear wire or post is mounted to one end of the ring, while the other free end is passed through the ear lobe and caused to engage the other end of the ring. One means of providing a secure connection is shown in U.S. Pat. No. 260,692 in which the body of the ring opposite the gap is provided with a spring-biased hinge, allowing the two ring halves to pivot with respect to one another. The ear wire is secured to the end of one ring half and, as the ring halves are pivoted relative to one another, the ear wire moves away from the end of the other ring half for insertion through the ear lobe, after which the ring halves are pivoted back to the closed position with the ear wire secured in the end of the other ring half.

Another loop earring connector is shown in U.S. Pat. No. 3,208,239. One end of the ear wire is pivotally attached to one end of the ring for movement in an arc that coincides with the plane of the ring. After insertion of the free end of the ear wire through the ear lobe of the wearer, the wire is pivoted in the plane of the ear ring, permitting the free end of the ear wire to be received in a notch formed in the other end of the ring and held therein with a friction fit. Other variations of this type of connection, sometimes referred to as a V connection, are known in the prior art.

A further variation in a connector for a circular or loop type pierced ear ring is shown in U.S. Pat. No. 3,673,815. The earring in this patent is made from flat bar stock rolled to form a ring with spaced ends forming a gap that is spanned by the ear wire. One end of the ear wire is formed with a loop connected to one free end of the ring and the other end of the ear wire is inserted into a lateral slot formed in the other free end of the ring. The loose pivotal connection of the ear wire to the ring permits pivotal movement in many directions requiring the wearer to exercise considerable dexterity in aligning the ear wire with the connecting slot.

German Patent No. 31731 disclosed a cuff link or button for clothes having an open loop-shaped body and a pivotally attached pin to close the open loop after attachment. However, the pin end is not secured.

SUMMARY OF THE INVENTION

In accordance with the present invention, a loop type earring includes a pivotally mounted ear post that pivots from an open position after insertion through the ear to a closed position along a confined arc that allows the free end of the post to readily snap into and lock in the other free end of the ring. The earring body has spaced opposed ends that define a gap sized to receive an ear lobe. An ear post that has a length greater than the gap has one end pivotally attached to an end of the ring body on a pivot positioned to permit movement of the free end of the post toward and away from the other end of the ring body. Pivotal movement of the post is confined to an arc that is transverse to the plane of the ring body. A locking detent is provided on the other end of the ring body and is sized to receive the free end of the post and to hold the same with a resilient locking bias.

The locking detent for the free end of the post comprises an indentation formed in one end of the ring body and includes an entry slot that is engageable by the free end of the post in response to movement along the transverse arc. The slot is dimensioned to cause a slight resilient deflection of the free end of the post as it passes into the slot, and the indentation includes a locking recess that opens inwardly from the slot is dimensioned to permit return of the free end of the post from its deflected state to lock it in the recess. The entry slot preferably includes a lead-in surface that is divergent in the direction of deflection of the free end of the post from the direction of movement along the transverse arc. The indentation also preferably includes a transition surface between the slot and the locking recess that is divergent in the direction of resilient deflection of the free end of the post from the reverse direction of post movement on the transverse arc.

The ear post preferably comprises a malleable metal wire having one end flattened for pivotal attachment to one end of the ring body. The pivotal attachment comprises a notch formed in one end of the ring body and defined by spaced end members, the notch being dimensioned to receive the flattened end of the post. Aligned holes are provided in the flattened post end and in the end members, and a pivot pin is received in the aligned holes and secured in the hole in at least one of the end members. The pin is preferably secured with an interference fit.

In the preferred embodiment, the ring body is generally annular in shape and the post is curved to conform generally to the annular shape of the body.

BRIEF DESCRIPTION OF THE DRAWINGS

FIG. 1 is a side elevation view of an ear ring utilizing the connector of the present invention.

FIG. 2 is an enlarged sectional view taken on line 2—2 of FIG. 1 showing the ear post received in the locking detent.

FIG. 3 is a side elevation view of FIG. 2.

FIG. 4 is an enlarged top plan detail of a portion of FIG. 1, showing the pivotal movement of the ear post with respect to the ring body.

FIG. 5 is an enlarged sectional detail taken on line 5—5 of FIG. 1.

DETAILED DESCRIPTION OF THE PREFERRED EMBODIMENT

Referring to FIG. 1, the earring connector the present invention is shown in use with a conventional circular body or simple loop-type earring 10. The body 11 of the earring has spaced opposed first and second ends 12 and 13, respectively, that define a gap 14 to accommodate the ear lobe of a wearer. Earring body 11 is closed by an ear wire or ear post 15 that passes through a hole in the ear lobe of the wearer. Although the invention is shown and described with respect to a simple circular earring body 11, it should be understood that the invention is applicable to virtually any type of earring that includes a gap within which the ear lobe of a wearer is located.

The ear post 15 is preferably formed from a piece of malleable metal wire, such as silver, commonly used for an ear wire or earring post. The first end 12 of the ear body 11 is provided with a notch 16 that extends through the end or a plane generally transverse to the plane of the ring body 11. One end of the ear post 15 is flattened and formed into a circular end 17 that is subsequently pierced to provide a hole 18 for receipt of a pivot pin 20. The notch 16 in the end 12 of the body is defined by a pair of spaced end members 21 which are also drilled or otherwise pierced to provide an aligned pair of pin holes 22. The pivot pin 20 is inserted through the aligned holes 18 and 22 and secured therein, preferably by providing an interference fit between one end of the pin and one or both pin holes 22. The hole 18 in the end of the post 15 is larger than the diameter of the pivot pin, allowing the post to pivot on the pin. However, a close tolerance is preferably provided between the end members 21 defining the notch 16 and the opposite faces of the circular end 17 of the post, such that pivotal movement of the post is substantially confined to a plane transverse to the plane of the ring body 11.

The ear post 15 is preferably bent in a circular arc that corresponds generally to the shape and diameter of the ring body 11. The opposite free end 23 of the ear post 15 is not formed in any particular manner and may simply by cut with a flat, squared-off end. The post has a length greater than the gap 14 such that when the post is pivoted from the open FIG. 4 position to the closed dotted line position, the free end 23 will engage the second end 13 of the ring body. The wearer inserts the free end 23 of the ear post through a hole pierced in the ear lobe and then simply pivots the ear post along its circular arc into locking engagement with the end 13 of the ring body 11. The special locking detent that receives and holds the free end 23 of the post in a locked position will be described as follows.

The second end 13 of the ring body is provided with a generally flat end face 24 in which is cut or otherwise formed an indentation 25 that provides a locking detent for the post end 23. The indentation 25 includes an entry slot 26 that is slightly below the path of movement of the post end 23 as the post pivots from the open position to the closed position. The entry slot is provided with a lead-in surface 27 that is preferably rounded and diverges from the direction of post movement downward in the direction of the slot opening. The inherent resilience of the ear post 15, possibly aided by a slight play in the pivot joint, causes the post end 23 to deflect slightly downwardly (toward the center of the ring body 11) as the wearer forces the post into engagement with the end of the ring body. The indentation 25 also includes a locking recess 28 into which the post end moves as a result of resilient return of the post end 23 from its slightly deflected state to lock the post in the closed position.

The transition between the surface of the locking recess 28 and the entry slot 26 is defined by a lead-out surface 30 that diverges in the same direction as the lead-in surface 27, the two surfaces 27 and 30 joining to define a locking lobe 31 that serves as a barrier to inadvertent opening of the locked ear post 15. This locking engagement is best shown in FIGS. 2 and 3. The wearer may open the earring for removal by forcing the ear post 15 to rotate in the reverse direction, whereby the inherent resilience of the post will cause the post end 23 to ride downwardly over the lead-out surface 30 and pass through the entry slot 26. Both attachment of the earring 10 to the ear and its removal are simple and, if necessary, may be accomplished using only one hand. Furthermore, pivotal movement of the ear post confined to the arc which is generally transverse to the plane of the earring causes the end of the ear post to engage the locking lobe 31 and to enter the entry slot 26 without any need for the wearer to carefully align mating parts. In other words, once the post has been inserted through the hole in the lobe of the wearer, it is only necessary to squeeze the post and the end 13 of the ring together to lock the post end 23 in the locking recess 28. Reverse movement for removal of the earring is equally simple and direct.

I claim:

1. An earring for a pierced ear, said earring comprising:

a ring body having spaced opposing ends defining a gap sized to receive an ear lobe;

an ear post having a length greater than the gap and having one end pivotally attached to one opposing end of the ring body on a pivot positioned to permit movement of an opposite free end of the post toward and away from the other opposing end of the ring body, said movement confined to an arc transverse to a plane of the ring body; and, a locking detent on the other opposing end of the ring body sized to receive the free end of the post and to hold the free end with a resilient bias, said locking detent comprising an indentation formed in said other opposing end of the ring body, said indentation including an entry slot engageable by the free end of the post in response to movement of said free end on said arc, said slot dimensioned to cause a slight resilient deflection of said free end as said free end passes through said slot, said entry slot including a lead-in surface divergent in a direction of resilient deflection of said free end from a direction of movement on said arc, said lead-in surface positioned to be engaged by said free end as said free end moves on said arc into said entry slot, and a locking recess in open communication with said slot and dimensioned to permit return of said free end from a deflected state to lock in said recess.

2. The earring connector as set forth in claim 1 wherein said indentation includes a transition surface between said slot and said recess that is divergent in a direction of resilient deflection from a reverse direction of movement on said arc.

3. The earring connector as set forth in claim 1 wherein said ear post comprises a malleable metal wire having said one end flattened for pivotal attachment to said one opposing end of the ring body.

4. The earring connector as set forth in claim 3 wherein the pivotal attachment comprises:

a notch in said one opposing end of the ring body defined by spaced end members, said notch dimensioned to receive the flattened end of the post;

aligned holes in said flattened end and end members; and, a pivot pin received in said aligned holes and secured in the hole in one of said end members.

5. The earring connection as set forth in claim 4 wherein said pin is secured with an interference fit.

6. The earring connector as set forth in claim 1 wherein said ring body is generally annular in shape and said post is curved to conform generally to the generally annular shape of the ring body.

* * * * *